US005319897A

United States Patent [19]

Royer

[11] Patent Number: 5,319,897

[45] Date of Patent: * Jun. 14, 1994

[54] AMUSEMENT PARK RIDE

[76] Inventor: George R. Royer, 316 N. Michigan (416), Toledo, Ohio 43624

[ * ] Notice: The portion of the term of this patent subsequent to Mar. 17, 2009 has been disclaimed.

[21] Appl. No.: 852,808

[22] Filed: Mar. 17, 1992

Related U.S. Application Data

[63] Continuation of Ser. No. 539,875, Jun. 18, 1990.

[51] Int. Cl.[5] ..... A63G 1/00

[52] U.S. Cl. ..... 472/30

[58] Field of Search ..... 472/30, 44, 45

[56] References Cited

U.S. PATENT DOCUMENTS 5,096,185 3/1992 Royer ..... 472/30

*Primary Examiner*—Carl D. Friedman
*Assistant Examiner*—Beth A. Aubrey

[57] ABSTRACT

The subject invention is an improved amusement park ride apparatus which is an adaptation of an upright vertical ferris wheel ride of the type that is rotated about a fixed axis, such invention being an up-right wheel structure having chairs thereon to hold riders as the wheel rotates in a vertical plane. The axle of rotation of the wheel is adapted to move horizontally along a horizontally disposed track, essentially back and forth between positions along such horizontally disposed track. In a further embodiment of the subject invention, the horizontal track up which the ferris wheel can move may be optionally mounted on a rotatable platform to yield a horizontal circular movement of the entire apparatus in addition to the foregoing reciprocal linear movement.

3 Claims, 1 Drawing Sheet

AMUSEMENT PARK RIDE

This patent application is a continuation of my patent application Ser. No. 07/539,875 filed Jun. 18, 1990.

DISCUSSION OF PRIOR ART AND BACKGROUND OF THE INVENTION

The subject invention relates to the general area of amusement park rides that are self-driven. In particular, the subject invention pertains to an improved adaptation of the ferris wheel, which is a conventional amusement park ride, and is an adaptation thereof.

This invention is adapted to provide an additional dimension or dimension of movement over and above the conventional movement of a vertical ferris wheel used as an amusement ride. Specifically, as is well known, the conventional ferris wheel amusement ride, or rides similar to the ferris wheel, is adapted to rotate while in a vertically upright plane, about a horizontally-fixed rotor. As is well known and which can be readily observed, the conventional ferris wheel apparatus is thus structured to rotate in a fixed vertical plane about a centrally disposed horizontal axle, which axle is disposed in a horizontal plane. As a result of this structural arrangement, the movement of the ferris wheel, as thus commonly known, is limited in its dimensional movement for rotation about a fixed axis in a fixed vertical plane. This latter aspect is well known in the pertinent art.

While a ferris wheel is indeed a thrill-inducing amusement ride for most people, there is always a constant quest to produce even more thrill-producing rides, with different and varying movements. In this latter respect, there is no amusement ride, of the nature of the basic overall ferris wheel movement, that has the added features of multiple dimensional movement which are in addition to the singular dimensional rotational movement described above. While many rides do produce certain multiple wheel moves about a horizontal axis and simultaneously rolls along a horizontal path. Moreover, there is no known amusement ride known by which the wheel also moves in a circular, horizontal plane over and above the foregoing described two movements.

This invention is adapted and conceived as an improved variation of a ferris wheel that will permit a ferris wheel, as known, to move in two or even three spatial dimensional movements. The following objects of the subject invention are directed accordingly.

OBJECTS

It is an object of the subject invention to provide an improved amusement park ride;

A further object of the subject invention is to provide a novel ferris wheel ride, with features of additional rotational movements over and above the usual rotational movement in a vertical plane;

Yet another object of the subject invention is to provide a multidimensional movement amusement ride;

A further object of the subject invention is to provide an improved amusement ride;

Still another object of the subject invention is to provide an amusement ride that has three modes of simultaneously movement;

A further object of the subject invention is to provide a novel amusement ride.

Yet another object of the subject invention is to provide an improved amusement apparatus based on multiple planar movement.

Other and further objects of the subject invention will become apparent from a reading of the following description taken in conjunction with the claims.

DRAWINGS

DESCRIPTION OF GENERAL EMBODIMENT

The subject invention is an improved amusement park ride apparatus which is an adaptation of an upright vertical ferris wheel ride of the type that is rotated about a fixed axis, such invention being an up-right wheel structure having chairs thereon to hold riders as the wheel rotates in a vertical plane. The axle of rotation of the wheel is adapted to move horizontally along a horizontally disposed track, essentially back and forth between positions along such horizontally disposed track. In a further embodiment of the subject invention, the horizontal track up which the ferris wheel can move may be optionally mounted on a rotatable platform to yield a horizontal circular movement of the entire apparatus in addition to the foregoing reciprocal linear movement.

DESCRIPTION OF PREFERRED EMBODIMENT

In described the preferred embodiment, it is to be stressed that the following description is of only one embodiment within the overall scope of the subject invention and that the subject invention may encompass other embodiments, as seen in the claims annexed hereto. Therefore, the following description shall not be considered as limiting the scope of the invention herein, as more fully set forth in the claims annexed hereto.

Figure 1:
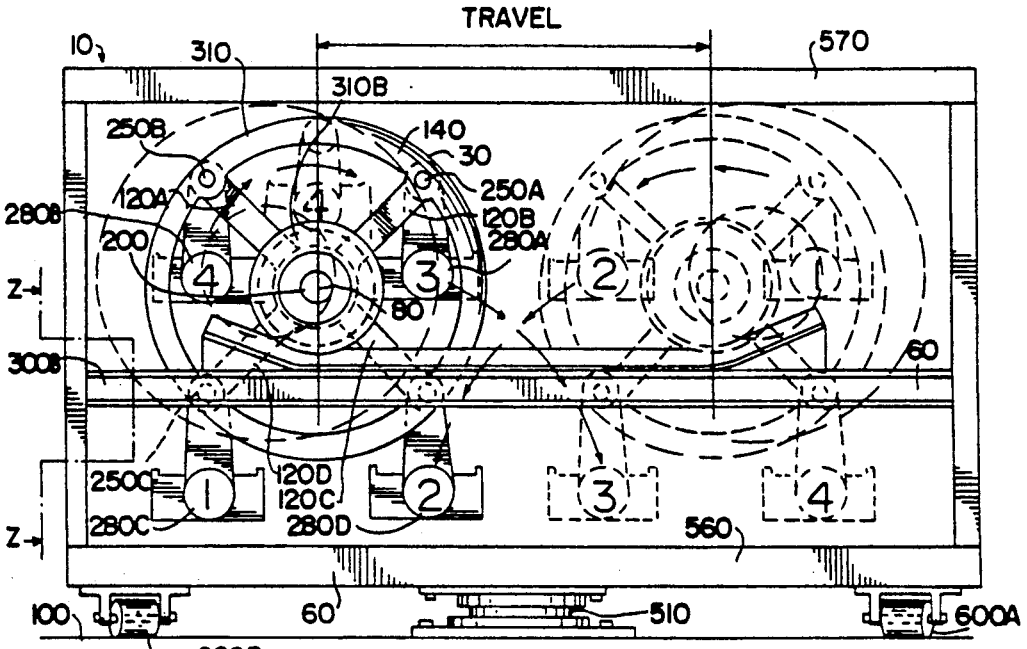
FIG. 1 is a side elevational view of the apparatus incorporating the subject invention.
Figure 2:
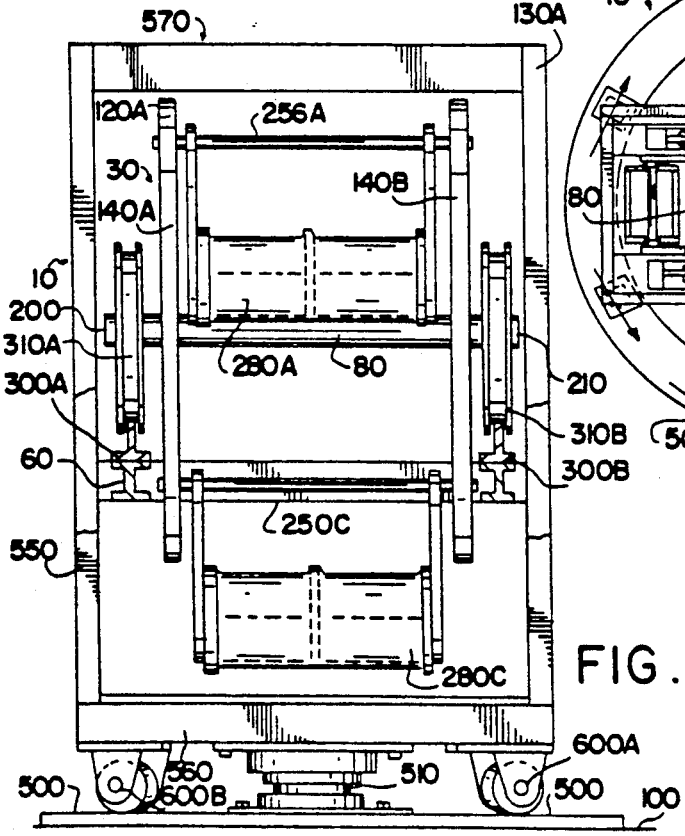
FIG. 2 is an end elevational view of the apparatus incorporating the subject invention.
Figure 3:
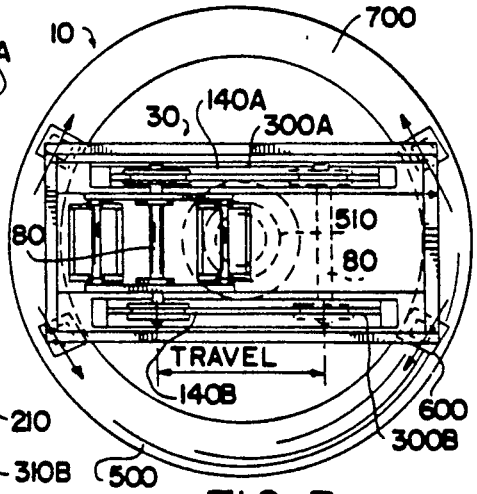
FIG. 3 is a top elevational view of the apparatus incorporating the subject invention.

Referring now to the drawings in which a preferred embodiment of the subject invention is shown. A ride apparatus 10 is shown as being the apparatus incorporating the features of the subject invention, such ride apparatus 10 being basically comprised of an upright rotatable wheel 30 of vertically upright disposition and a generally horizontal support and guide ramp 60. The rotatable wheel 30 is generally constructed along the mechanical principles of a conventional ferris wheel which is rotatable in a vertical plane about a fixed horizontal axis, but with the additional features of this invention as more fully discussed below. For this latter purpose, the rotatable wheel 30 is mounted on a centrally disposed axle 80 having a first end 200 and a second end 210 such axle being generally and preferably mounted in a horizontal position relative to the ground surface 100, as seen in FIGS. 1 and 2. In the usual construction of a ferris wheel member, the axle 80 is mounted some distance above the ground usually at least by a vertical distance that is usually marginally greater than the radius of the wheel 30 itself.

As can be observed from the drawings, and particularly FIG. 1, the rotatable wheel is provided with a plurality of radially extending support spokes disposed radially on each side of the axle. Radial spokes 120A, 120B, 120C and 120D are integrally affixed directly or indirectly to end 200 of central axle 80, while the opposing mating spokes are not shown. These latter described support spokes are longitudinally extending, rigid members affixed directly or indirectly on their inner ends to respective ends 200 and 210 of the axis 80, and each such spoke projects radially outwardly, as seen, with all such spokes being preferably of an equal length from such central axle 80, as shown. The number of such radial spokes may vary in number depending on the size and the characteristics of the wheel and the representation of the embodiment shown in the drawings with eight such spokes being exemplary only. In the larger type of ferris wheel, there are correspondingly more support spokes. Thus, in the usual embodiment, although this is not critical, each set of radial spokes parallel the other mating radial spokes.

As can be seen from the drawings, the preferred embodiment of the subject invention, affixed to the outer extremity of the radial spokes 120A, 120B, 120C and 120D is a circumferentially extending outer rim member 140A. This circumferentially extending outer rim 140A is preferably, although not critical, a continuous member that defines the outer extremity of the wheel 30. In similar fashion, circumferential rim 140B is integrally and circumferentially disposed on the radially outer extreme portions of the radial spoke members integrally affixed to the second end 210 of the axle 80. The two circumferential rim members 140A and 140B together form the outer circumferential extremity of the wheel 30, and both such rim members 140A and 140B are preferably of a similar diameter and also are preferably situated relative to one another in parallel planes, with a spatial area between such rims. Such spatial area between the rims 140A and 140B is the area in which seating members are affixed, as more fully discussed below.

As can be seen from the drawings, in the preferred embodiment of the subject invention, joining mating portions of the interior surface of the respective rim members 140A and 140B are a series of horizontal bar members 250A, 250B, 250C and 250D. These horizontal bar members 250A, 250B, 250C and 250D are usually and preferably cylindrically-shaped members joined at those portions of the circumferential rim members 140A and 140B where the radial spokes join to the rim. The function of such horizintal bar members is multifaced, one being to join the rim members together to maintain the integrity of the wheel, and secondly, the horizontal bars function to hold rotatably mounted seat members 280A, 280B, 280C and 280D. The seat members 280A, 280B, 280C and 280D may vary in number, shape and other aspects depending on the overall size of the wheel. The seat members 280A, 280B, 280C and 280D are affixed to the respectively connected joiner bar in a limited rotational manner, so that the seat may move back and forth a limited degree as the wheel 30 rotates about the axle. One of the main functions of this limited rotational ability is to keep the seat member substantially aligned up and down in a vertical plane, with the help of gravity, as the wheel rotates about the axle 30.

The wheel member 30 as thusly described above is conventional in construction as a basic ferris wheel structure as known in the art and no novelty is claimed in the constructional arrangement of the wheel 30 itself, or the concept of each wheel rotating with riders thereon about a fixed axle, as described above. The additional and improved features to this wheel are as described below.

As can be seen from FIGS. 1 and 2, means are integrally affixed to either one or both ends of the wheel axle to permit the wheel 30 to roll in a rolling manner, in addition to its rotational movement, so that the wheel 30 can be rolled along in a linear line. More specifically, mounted integrally and concentrically on the ends 200 and 210 of the axle 80 are flanged wheel members 310A and 310B respectively. These flanged wheel members 310A and 310B are integrally and concentrically mounted to the ends 200 and 210 of the axle 80. Motive means, such as a motor, not shown, can be geared or connected to the axle 80 to cause said axle to be moved in a linear path along a given linear track or similar mechanism.

As seen in the drawings, a support platform 550 is provided to support the wheel 30 and can be elevated above the ground level 100. Preferably, the support platform 550 is of such a height that it can support the wheel 30 above the ground level so that the wheel 30 can be rotated from ground level at above.

In the embodiment shown in the drawings, the support platform is shown as being a rectangular structure, although this configuration is not critical. The platform 550 has an upper frame member 570 and a lower base frame member 560, as well as side frame members 550 and 560. Disposed inside said frame, in a longitudinally extending disposition are parallel track members 300A and 300B, such parallel track members being integrally supported to the side frame members 555 and 560 of support frame 550. Flanged wheel members 310A and 310B of the ride wheel 30 are placed on and adapted to ride along rails 300A and 300B in a rolling movement along the extent of the rails 300A and 300B. As can be seen from the drawings, the track members 300A and 300B extend the length of the support frame, and are blocked by the respective ends of the support frame so that the wheels 310A and 310B cannot transverse beyond such limits.

Thus, as can be seen, the wheel 30 can roll from one end of the support platform 550 to the other. Thus, the wheel 30 will rotate in a vertical plane about axle 80, and will also roll along the rails 300A and 300B, as an added movement aspect, with motive means, such motive means being geared or connected to the axle cause the axle 80 to rotate about its axis and by this latter feature causes the axle to rotate causing the wheel 30 to rotate about such axle in a vertical plane as well as roll along the parallel track means in a linear movement along such track members.

The support ramp 550 is preferably positioned above ground level 100 or positioned at some distance above the ground, as shown, however, other variations are envisioned whereby the wheel 30 can rotate and roll along a path simultaneously. In this respect, a linear pit can be used as an alternative with the wheel moving partly underground level at any time. Other variations on this aspect are available.

As can be seen from the drawings, in another embodiment of the invention the support platform is rotatably affixed on a 510 cylindrical support affixed upright to the ground 100. The support platform by this embodiment can rotate on rollers 600A and 600B around a circular track 700. By this embodiment, yet another movement dimension is introduced for the ride which incorporates the inventive features herein.

In summary, the subject invention is an amusement ride, based on an improvement of a ferris wheel assembly comprising a rotatable wheel member with a base platform member, such base platform assembly being affixed to the ground and wherein such platform has track members, and wherein such wheel member is rotatably mounted on such tracks on such platform member.

Alternately stated, the subject invention is an amusement ride, based on an improvement of a ferris wheel assembly, comprising a base platform assembly, such base platform being affixed to the ground and wherein such platform is elevated above the ground, and wherein such platform member has linear track members thereon, with a rotatable wheel adapted to ride on such track members.

Also summarized in another manner, the subject invention is a novel ferris wheel apparatus for emplacement on the ground comprising a platform member, such platform member having an imaginary longitudinal central axis extending along the longest extent of such platform member, such platform member having longitudinally extending track members thereon with a vertically disposed rotation member having an axle of rotation about which such rotatable member is adapted to rotate about and rotatably mounted on such track member.

I claim:

1. An amusement ride, based on an improvement of a ferris wheel assembly comprising:

(a) a base support platform assembly, said base support platform being affixed to the ground wherein said platform is elevated above the ground, and wherein said platform member has two parallel linear track members thereon;

(b) a rotatable ferris wheel with a plurality of passenger seats disposed thereon, said wheel having a central rotatable axle member which axle member is adapted to ride on said two parallel linear track members, along a linear path.

2. A novel ferris wheel apparatus comprising:

(a) a longitudinally extending member, said support member having an imaginary longitudinal central axis extending along the longest extent of such platform member, said platform member having longitudinally extending track members thereon, and further wherein said support platform member is adapted to rotate in a plane parallel to the ground about a vertical axis;

(b) a vertically disposed rotatable member having an axis of rotation about which said rotatable member is adapted to rotate about and which rotatable member is rotatably mounted on said track member.

3. An amusement ride with a plurality of passenger seats thereon, said ride adapted to provide simultaneously multidimensional movement comprising:

(a) a first and second parallel extending support member with said first parallel member having a first and second end and said second parallel member having a first end and a second end;

(b) a vertically disposed rotatable wheel member having a plurality of passenger seats thereon, having an axle of rotation, with said axle of rotation having a first end and a second end, with said first end of said axle being rotatably engaged with said first parallel extending member and said second end of said axle being rotatably engaged with said parallel extending member.

* * * * *